United States Patent [19]

Tachibana et al.

[11] Patent Number: 4,648,705

[45] Date of Patent: Mar. 10, 1987

[54] CLEANING DEVICE

[75] Inventors: Natsuki Tachibana, Kamakura; Issey Ichihara, Chiba, both of Japan

[73] Assignee: Kabushiki Kaisha Toshiba, Kawasaki, Japan

[21] Appl. No.: 733,795

[22] Filed: May 14, 1985

[30] Foreign Application Priority Data

May 23, 1984 [JP] Japan ..... 59-104025

[51] Int. Cl.[4] ..... G03G 21/00

[52] U.S. Cl. ..... 355/15; 15/256.51

[58] Field of Search ..... 355/3 R, 15; 15/256.51, 15/256.52

[56] References Cited

U.S. PATENT DOCUMENTS

| | | | |
|---|---|---|---|
| 3,791,729 | 2/1974 | Steiner | 355/3 R |
| 4,032,228 | 6/1977 | Whited | 355/15 |
| 4,516,849 | 5/1985 | Tsutsui et al. | 355/15 |

*Primary Examiner*—Fred L. Braun

*Attorney, Agent, or Firm*—Oblon, Fisher, Spivak, McClelland & Maier

[57] ABSTRACT

A cleaning device provided in an image forming apparatus includes a cleaning blade for scraping residual developing agent from an image carrier after a sheet of paper with a visual image has been peeled from the image carrier, and an auger for moving the scraped agent to collect the same. The cleaning device further includes a shield plate provided near the cleaning blade to prevent the paper from entering the housing of the cleaning device.

4 Claims, 4 Drawing Figures

CLEANING DEVICE

BACKGROUND OF THE INVENTION

The present invention relates to a cleaning device for removing residual developing agent from an image carrier of an image forming apparatus such as an electronic copier.

FIG. 1 shows a conventional cleaning device 10 used in an image forming apparatus. Device 10 comprises a blade 14 and an auger 16. Blade 14 contacts an image carrier 12 at one tip 14*a* to scrape residual developing agent T from image carrier 12. Auger 16 is provided below blade 14 to move the scraped agent T to one side of the housing 18 of the image forming apparatus.

The image forming apparatus has a peeling charger 20 and a peeling error detector 24. When charger 20 fails to peel paper P from image carrier 12, peeling error detector 24 generates an alarm. Hearing this alarm, the operator looks into housing 18. However, paper P has already been peeled and guided by tip 14*a* into the housing 22 of device 10 through a gap a between tip 14*a* and auger 16. The operator cannot see paper P and misunderstanding, believes that there is no paper. Paper P is left unnoticed and unremoved. Here arises a problem. Paper P in housing 22, which has been crunched up, not only scratches the surface of image carrier 12 but also inevitably scrapes developing agent T from the next sheet of paper P.

In the case of an image forming apparatus with no peeling error detector detectors, the uppermost sheet P, which have been erroneously fed one upon the other in continuous copying operation, is likely to enter housing 22, while the other blank sheets P are moved to the copy tray. If the uppermost sheet P enters housing 22 and is crunched up, it may push blade 14 onto image carrier 12 so hard that blade 14 is broken, and may push an auxiliary blade (not shown) onto carrier 12 such that the auxiliary blade scrapes agent T from the next sheet of paper P.

SUMMARY OF THE INVENTION

Accordingly, the object of the present invention is to provide a cleaning device which is designed to remove residual developing agent from an image carrier of an image forming apparatus, and which can detect a sheet of copying paper erroneously remaining on the image carrier, can prevent such a sheet from entering the image forming apparatus, from scratching the image carrier, from hindering the removal of residual developing agent and from scraping the agent from the next sheet of paper.

According to this invention, there is provided a cleaning device comprising a blade for scraping residual developing agent from an image carrier after a sheet of paper with a visual image has been peeled from the image carrier, an auger for moving the scraped agent T to collect the same. The device further comprises a shield plate provided near the blade to prevent the paper from entering the housing of the cleaning device.

BREIF DESCRIPTION OF THE DRAWINGS

DETAILED DESCRIPTION OF THE PREFERRED EMBODIMENT

An embodiment of this invention, i.e., a cleaning device used in an electronic copier 30, will be now described with reference to FIGS. 2–4.

Figure 1:
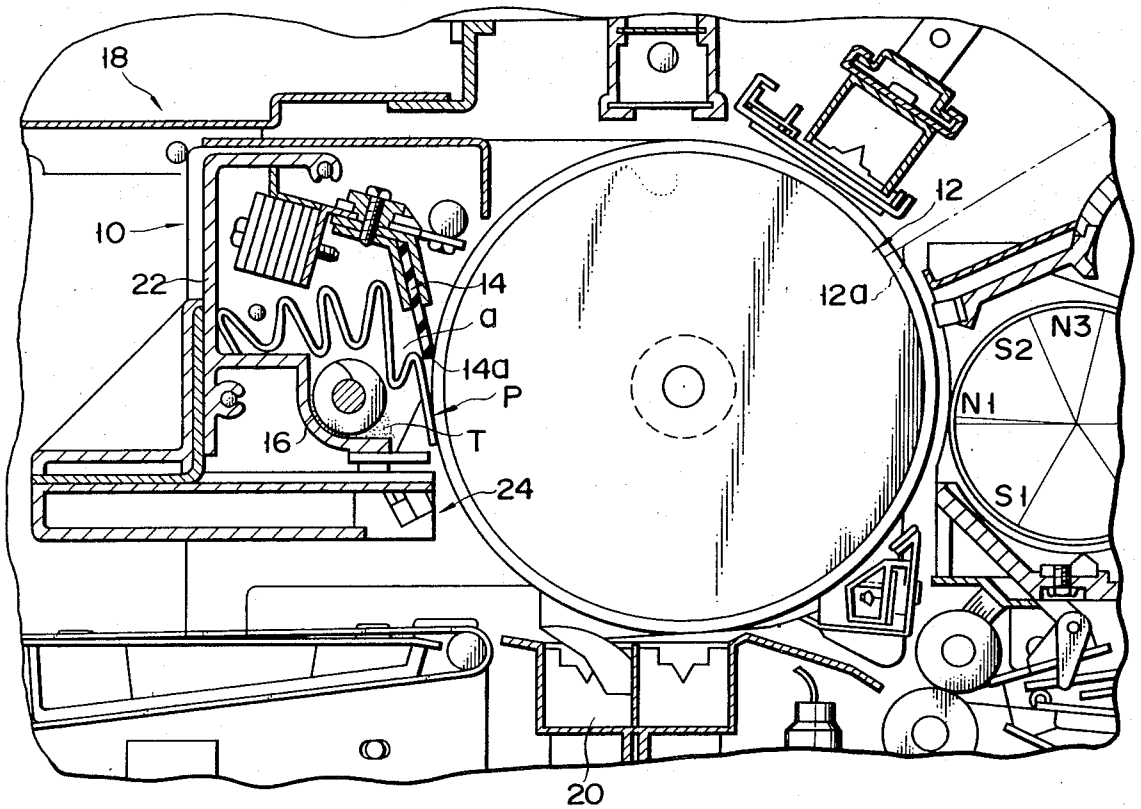
FIG. 1 (PRIOR ART)
FIG. 1 is a sectional side view of an image forming apparatus with the conventional cleaning device.
Figure 2:
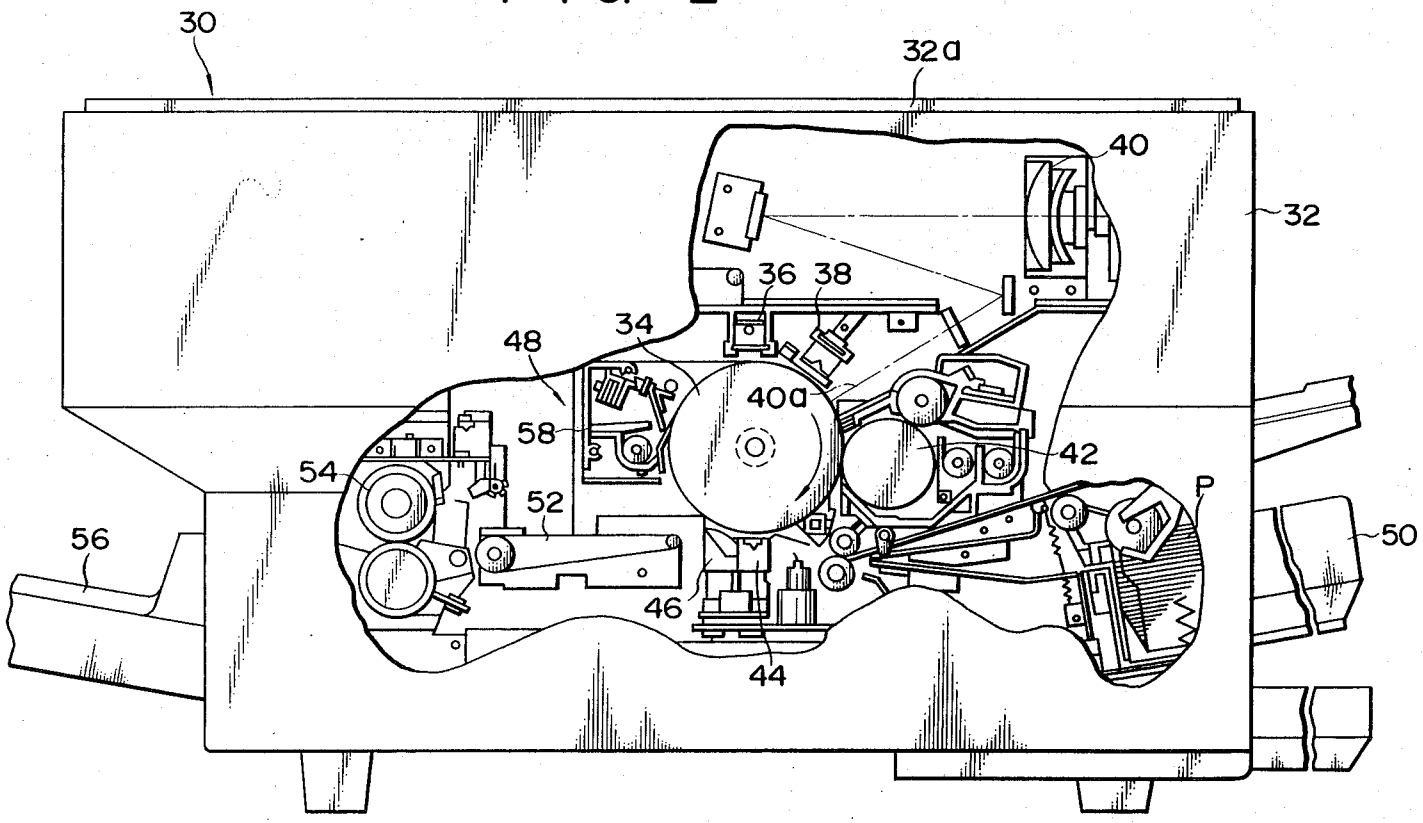
FIG. 2 is a sectional side view of an image forming apparatus with a cleaning device according to this invention

As shown in FIG. 2, copier 30 has a housing 32. An image carrier 34, or a photosensitive drum, is provided within housing 32. A discharge lamp 36, a charger 38, an image focussing unit 40*a* (i.e., a component of an exposure device 40), a developing device 42, a transfer charger 44, a peeling charger 46 and a cleaning device 48 are arranged around image carrier 34, in the direction in which carrier 34 is rotated. Charger 38 uniformly charges the surface of image carrier 34. An original is placed on a table 32*a* provided on the top of housing 32. Image focussing unit 40*a* focuses the image of the original on the surface of image carrier 34, thus forming an electrostatic latent image. Developing device 42 applies a developing agent to image carrer 34, thereby developing the latent image. Transfer charger 44 transfers this image onto a sheet of paper P supplied from a paper cassette 50. Paper P is then peeled from image carrier 34 by peeling charger 46 and transported to a fixing device 54 by a belt conveyor 52. Fixing device 54 heats paper P, thus fixing the developed image. Thereafter, paper P is discharged into a copy tray 56 provided outside housing 32. In the meantime, cleaning device 48 scrapes residual developing agent from image carrier 34, thereby cleaning image carrier 34. The surface of image carrier 34 thus cleaned is electrically discharged by discharge lamp 36.

Cleaning device 48 has a housing 58 which opens at one side opposing image carrier 34. As shown in FIG. 4, a cleaning blade 60 is arranged within housing 58. The tip 60*a* of this blade contacts the surface of image carrier 34. An auger 62 is also provided within housing 58, below cleaning blade 60. Tip 60*a* scrapes the residual developing agent T from the surface of image carrier 34. The scraped agent falls and is collected at one side of housing 58 as auger 62 rotates.

Figure 3:
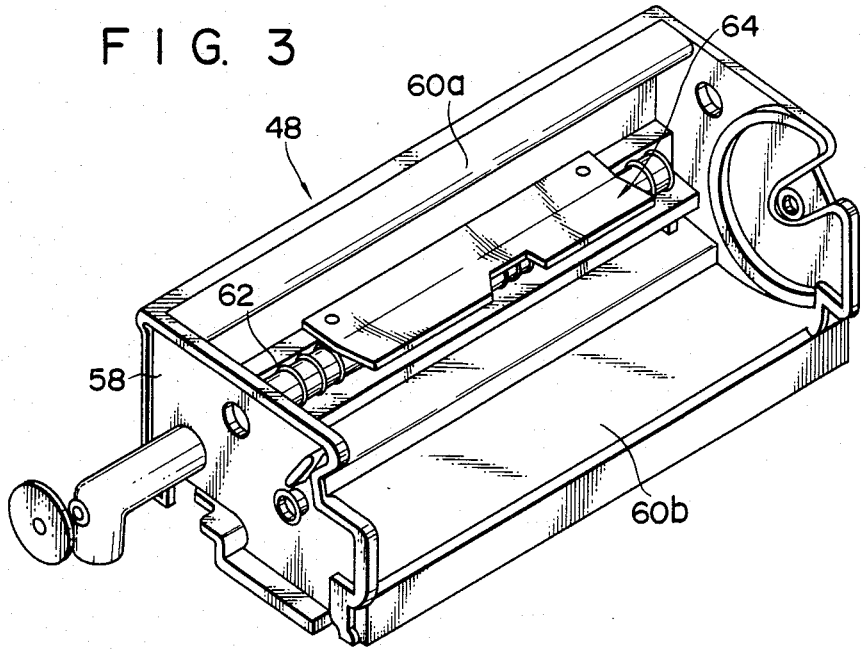
FIG. 3 is a perspective view of the cleaning device used in the apparatus of FIG. 2.
Figure 4:
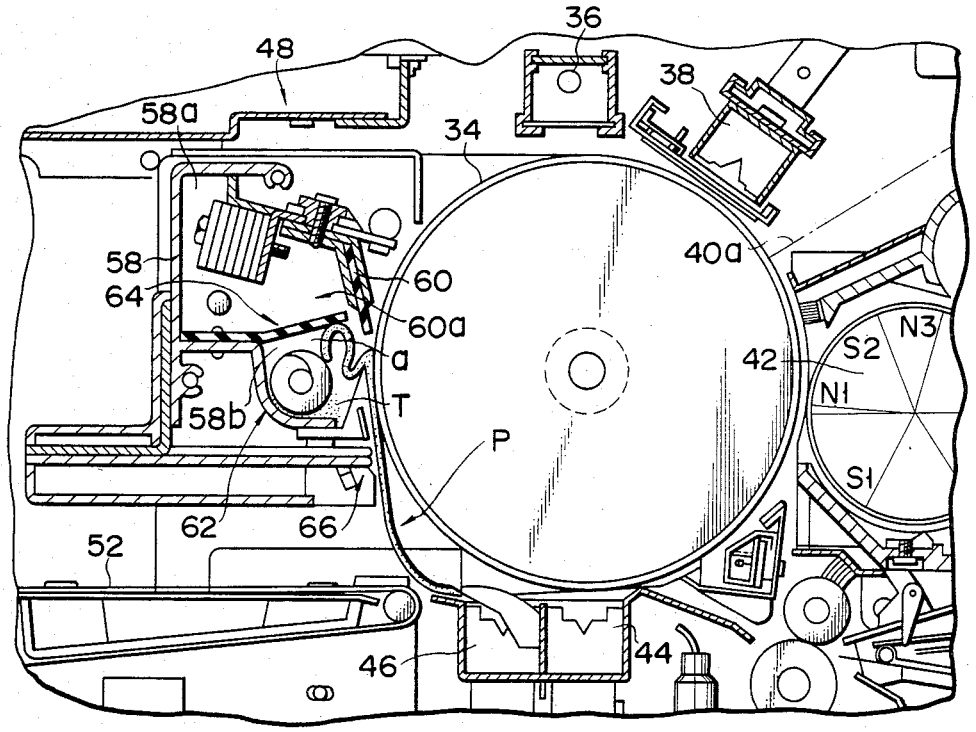
FIG. 4 is a sectional side view of the apparatus shown in FIG. 2, showing how paper is jammed.

As shown in FIG. 3, a shield 64 is provided above auger 62, filling the gap "a" between tip 60*a* and auger 62. More specifically, shield 64 has its tip positioned behind the tip 60*a* of blade 60 and divides the interior of housing 58 into a chamber 58*a* containing blade 60 and a chamber 58*b* containing auger 62. If peeling charger 46 fails to peel a sheet of paper P, shield 64 prevents this paper P from entering chamber 58*a*.

As described above, even if the front portion of paper P left unpeeled, is peeled, and enters housing 58, shield 64 stops paper P. Paper P cannot enter housing 58 and stays in chamber 58*b*. Hence, the operator, who looks into housing 32 upon hearing an alarm made by a peel error detector 66, can see this paper P and remove it from housing 32. Paper P is never left unnoticed. Hence, image carrier 34 is not scratched, nor is the developing agent always scraped from the next sheet of paper P. Any sheet of paper P that peeling charger 46 has failed to peel from image carrier 34 is held in the vicinity of transfer charger 44 or peeling charger 46. Even if copier 30 is not provided with a peeling error detector, such a sheet of paper can be detected by a jam detector provided near chargers 44 and 46. When the jam detector detects the paper, it outputs a signal which stops copier 30.

What is claimed is:

1. A cleaning device for removing residual developing agent from the surface of an image carrier, thereby cleaning the surface, after an image has been transferred from the image carrier to a sheet of paper, said device comprising:

a housing with an opening cut in one side opposing said image carrier;

a cleaning blade provided within said housing and contacting at one end the surface of the image carrier for scraping residual developing agent from the surface of the image carrier;

conveying means provided within said housing, below said cleaning blade, for receiving the developing agent scraped from the image carrier and conveying the same to one side of said housing; and means provided within said housing for preventing a sheet of paper from entering said housing, said sheet having been carried by the image carrier to the cleaning device and then peeled by said cleaning blade from the image carrier, said preventing means including a shield dividing said housing into a first chamber in which said cleaning blade is held and a second chamber in which said conveying means is held.

2. The cleaning device according to claim 1, wherein said shield has an edge positioned close behind said cleaning blade.

3. The cleaning device according to claim 2, wherein said shield is a plate filling a gap between said cleaning blade and said conveying means.

4. The cleaning device according to claim 2, wherein said conveying means has an auger extending at right angles to the direction in which said image carrier moves.

* * * * *